US007607970B1

(12) United States Patent
Chuang

(10) Patent No.: US 7,607,970 B1
(45) Date of Patent: Oct. 27, 2009

(54) PLANING AND POLISHING MACHINE

(76) Inventor: Bor-Yann Chuang, No.78, Yungfeng Rd., Taiping City, Taichung County (TW)

( * ) Notice: Subject to any disclaimer, the term of this patent is extended or adjusted under 35 U.S.C. 154(b) by 0 days.

(21) Appl. No.: 12/174,135

(22) Filed: Jul. 16, 2008

(51) Int. Cl.
*B24B 49/00* (2006.01)

(52) U.S. Cl. ..... 451/11; 451/65; 451/69; 451/70; 144/114.1

(58) Field of Classification Search ..... 451/11, 451/65, 67, 69, 70; 144/114.1, 117.1, 2.1, 144/3.1, 1.1, 38, 129, 130
See application file for complete search history.

(56) References Cited

U.S. PATENT DOCUMENTS 2,376,262 A * 5/1945 Lorant et al. ..... 474/72
2,664,758 A * 1/1954 Smits ..... 474/84
2,877,608 A * 3/1959 Clitty ..... 451/415
3,379,230 A * 4/1968 Roehrig ..... 144/1.1
3,559,804 A * 2/1971 Lytton ..... 209/3
3,653,159 A * 4/1972 Ladewig ..... 451/67
4,938,111 A * 7/1990 Masse ..... 83/425.3
5,285,600 A * 2/1994 Shepley ..... 451/54
6,289,950 B1 * 9/2001 Chiang ..... 144/117.1
6,722,960 B2 * 4/2004 Brooks ..... 451/65
2004/0250882 A1 * 12/2004 Wixey et al. ..... 144/114.1
2006/0011265 A1 * 1/2006 Liu ..... 144/117.1
2008/0264519 A1 * 10/2008 Smith et al. ..... 144/114.1

* cited by examiner

*Primary Examiner*—Maurina Rachuba
(74) *Attorney, Agent, or Firm*—Ming Chow; Sinorica, LLC

(57) ABSTRACT

A planning and polishing machine includes a base, an intermediate base installed with a conveying device for laying a workpiece, and an upper base pivotally fixed with at least a planer and a grinding roller. A driving motor is installed below the conveying device, with its shaft engaged with a first driving wheel and a second driving wheel with different diameters. The first driving wheel and the blade are mounted by a first driving element, and the second driving wheel and the grinding roller are mounted by a second driving element. When the driving motor is turned on to draw the first driving element and the second driving element, the blade and the grinding roller are to be meanwhile driven to rotate in different rotating speeds, enabling the blade to powerfully plane the surface of a wood, achieving a high precision and efficiency of planning and polishing.

6 Claims, 5 Drawing Sheets

PLANING AND POLISHING MACHINE

BACKGROUND OF THE INVENTION

1. Field of the Invention

This invention relates to a planing and polishing machine.

2. Description of the Prior Art

Commonly, woods are planed and polished respectively by a conventional planer and a conventional polisher. The polisher can only grind off slightly and the planer can merely plane so roughly that an additional grinder is ever needed for further grinding. As shown in FIG. 1, a conventional planing and polishing machine mainly includes a base 1, an intermediate base 2, a conveying device 3, an upper base 4 and a driving motor 5. Transversely and pivotally connected on the upper base 4 are a blade 6 and two grinding wheels 7, with one end of a shaft 8 of each of the grinding wheels 7 extended outside the upper base 4. The shafts 8 and a driving shaft 5A of the driving motor 5 are mounted by a first belt (B). The blade 6 has one end of its shaft 9 extended outside the upper base 4 and linked with the shaft 8 of the adjacent grinding wheel 7 by a second belt (C), enabling it simultaneously driven to whirl to carry out planing when turning on the driving motor 5 to drive the grinding wheels 7. By the time, a piece of wood can be put on from a front side of the intermediate base 2 for being planed and polished.

As the blade 6 is to cut off the surface of a workpiece, it needs a higher rotating speed than the grinding wheels do. However, the blade 6 is indirectly driven by the grinding wheels 7, it can't be whirled as quick as needed to sufficiently plane, possible to lower its working precision.

SUMMARY OF THE INVENTION

The object of this invention is to offer a planing and polishing machine able to drive its blade and its grinding wheel to rotate in different speeds so as to enhance dynamic efficiency and machining precision.

The planing and polishing machine includes a base, an intermediate base installed with a conveying device for laying a workpiece, and an upper base pivotally fixed with at least a planer and a grinding roller. A driving motor is installed below the conveying device, with its shaft engaged with a first driving wheel and a second driving wheel with different diameters. The first driving wheel and the blade are mounted by a first driving element, and the second driving wheel and the grinding roller are mounted by a second driving element.

According to the characteristics mentioned above, as the driving motor is turned on to draw the first driving element and the second driving element, the blade and the grinding roller are to be independently driven to simultaneously rotate in different speeds, enabling the blade to powerfully cut off the surface of a workpiece, achieving a boosted dynamic efficiency and a high precision of planning and polishing.

BRIEF DESCRIPTION OF DRAWINGS

This invention is better understood by referring to the accompanying drawings, wherein.

DETAILED DESCRIPTION OF THE PREFERRED EMBODIMENT

Figure 1:
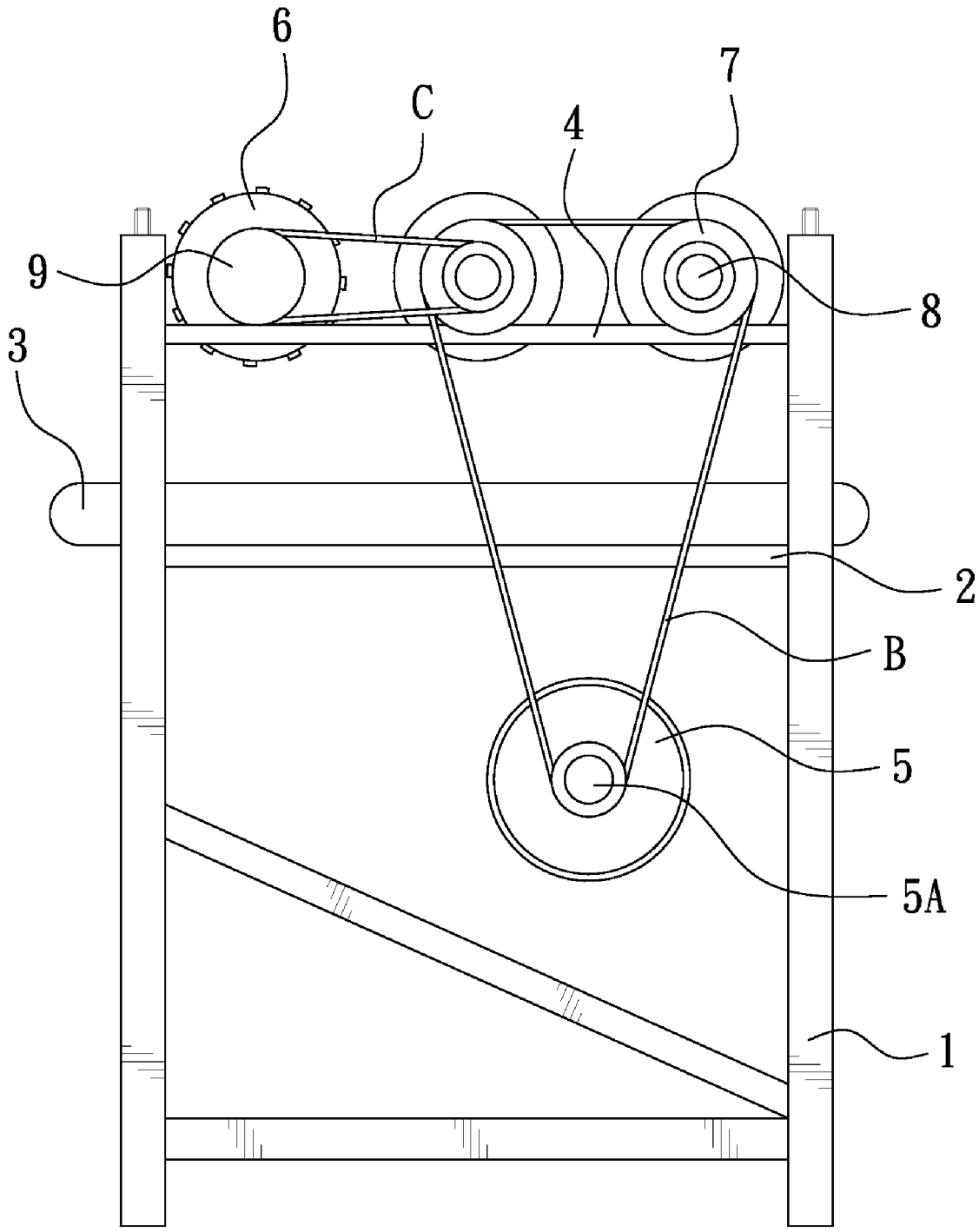
FIG. 1 PRIOR ART
FIG. 1 is a schematic side view of a conventional planing and polishing machine.
Figure 2:
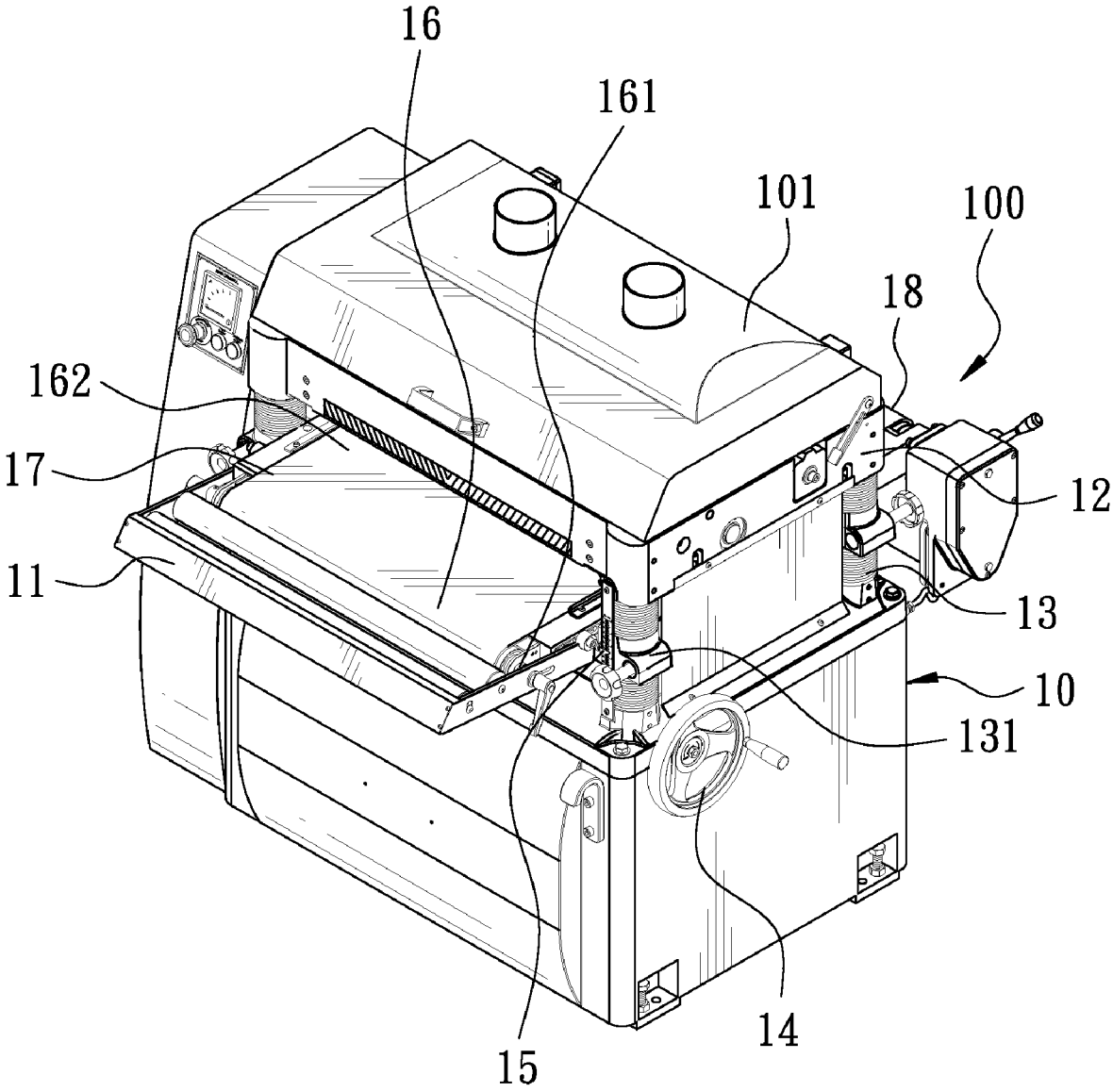
FIG. 2 is a perspective view of a preferred embodiment of a planing and polishing machine in the present invention.
Figure 3:
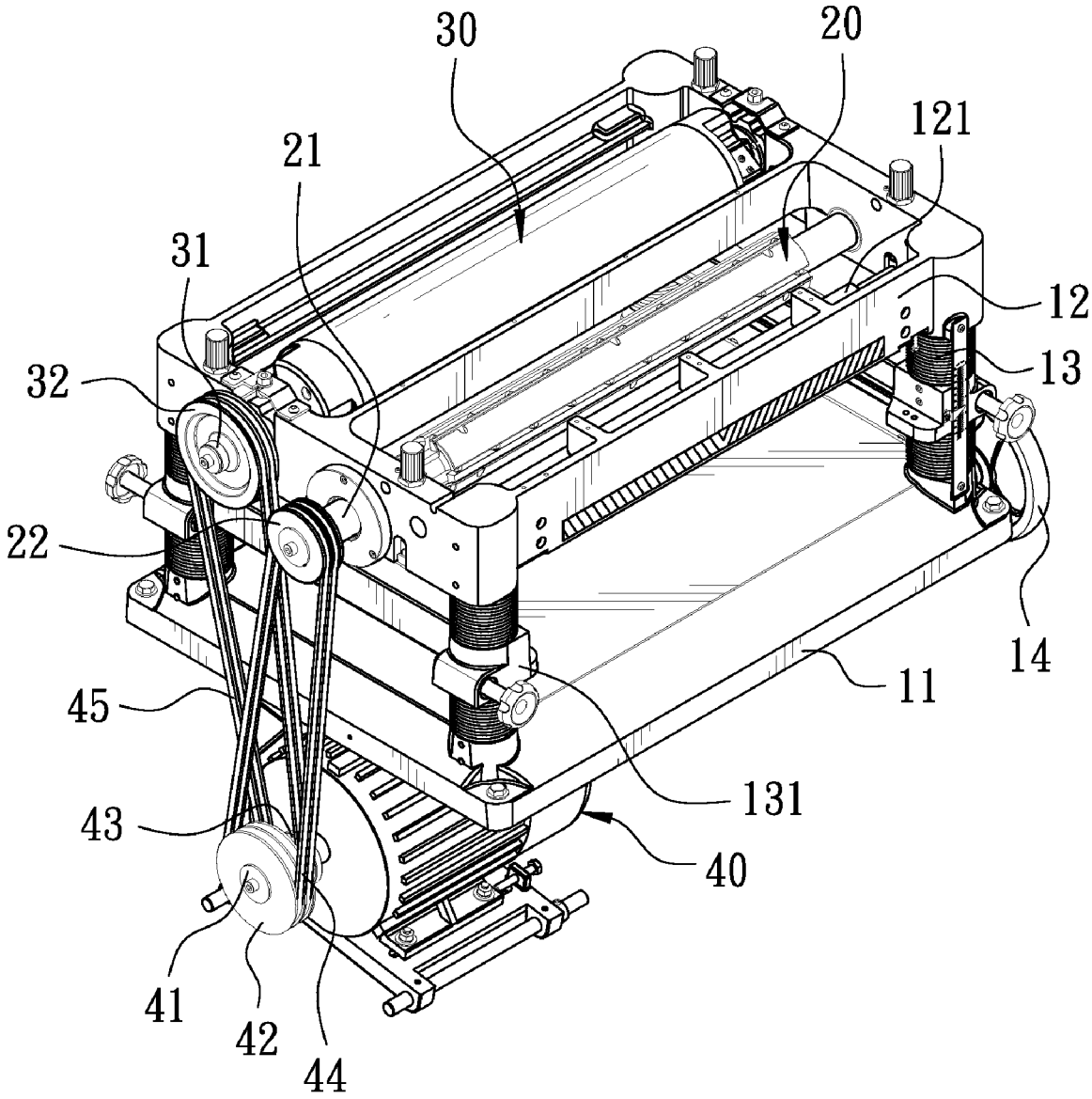
FIG. 3 is a partial perspective view of the preferred embodiment of a planing and polishing machine in the present invention, showing how a driving motor is linked to a blade and a grinding wheel.

As shown in FIGS. 2 and 3, a preferred embodiment of a planing and polishing machine 100 in the present invention is covered by a hood 101, provided with a base 10, a blade 20, a grinding wheel 30 and a driving motor 40.

The base 10 is formed as a platform, employed to keep the planing and polishing machine 100 stably positioned on it. Sequentially installed above the base 10 are an intermediate base 11 and an upper base 12 formed as a rectangular frame. The intermediate base 11 is installed on the base 10, with each of its corners fixed with an adjusting screw 13 that is fixedly positioned on the base 10, used to adjust the distance between the intermediate base 11 and the upper base 12 so as to enable a workpiece properly planed. A transverse rod 131 is axially linked between two adjacent adjusting screws 13 at two sides of the intermediate base 11 respectively. An adjusting wheel 14 is installed at one side of one of the adjusting screws 13 for altering the level of the intermediate base 11 and a scale 15 is fixed beside one of the adjusting screws 13. Installed on the intermediate base 11 is a conveying device 16, which is utilized to transport a piece of wood ready for being finished, composed of a front and a rear shaft 161 and a conveying band 162. The front end and the rear end of the conveying device 16 are denoted as an input 17 and an output 18 respectively. The conveying band 162 has a rough surface with a high friction coefficient, axially mounted around the shafts 161 on the intermediate base 11. And the upper base 12 is provided with a roller 121 that is fixed at its two sides respectively and simultaneously driven to rotate while moving a workpiece.

Figure 4:
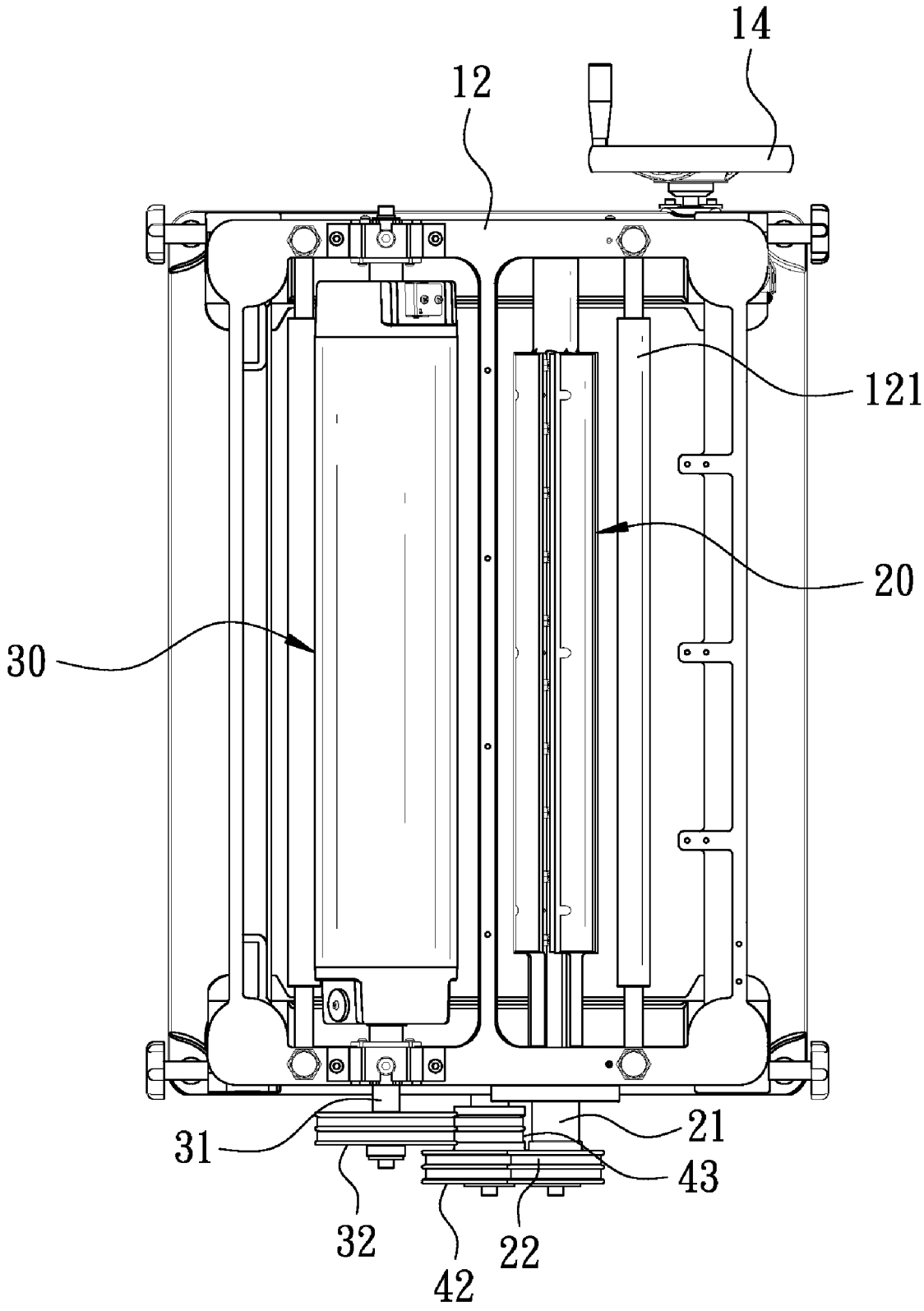
FIG. 4 is a top view of the preferred embodiment of a planing and polishing machine in the present invention.
Figure 5:
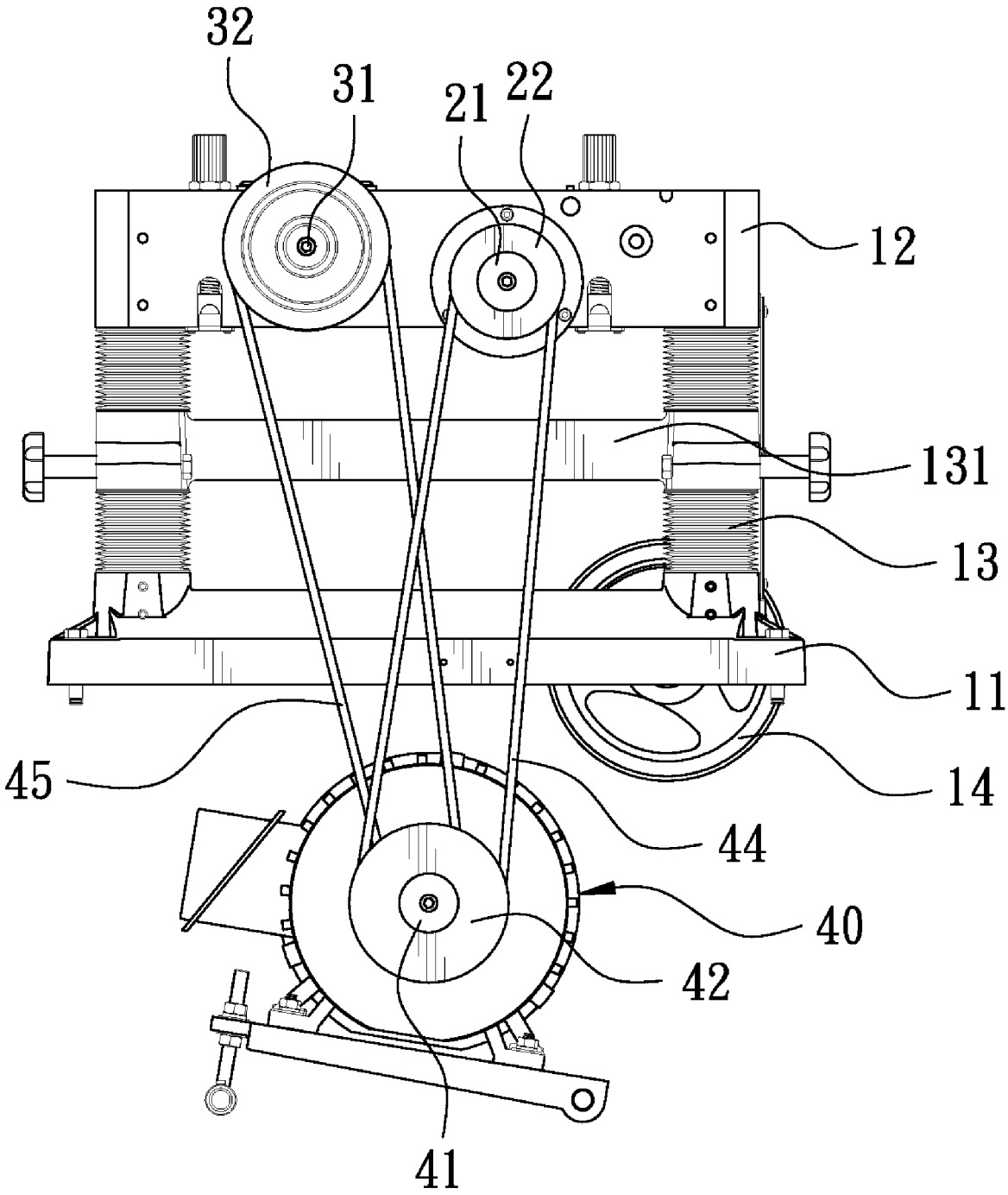
FIG. 5 is a side view of the preferred embodiment of a planing and polishing machine in the present invention, showing how the driving motor is linked to the blade and the grinding wheel.

The blade 20, as shown in FIGS. 4 and 5, is pivotally positioned between the rollers 121 above the upper base 12, directed to the input 17 of the conveying device 16 and provided with a shaft 21 pivotally connected at its one side to extend outside the upper base 12 for engaging with a first rotating wheel 22.

The grinding wheel 30 is also pivotally installed between the rollers 121 above the upper base 12, properly spaced apart from the blade 20 and positioned above the output 18 of the conveying device 16. A shaft 31 is pivotally connected at one side of the grinding wheel 30 to extend outside the upper base 12 for being mounted by a second rotating wheel 32 next to the first rotating wheel 22. The surface of the grinding wheel 30 is closer to the conveying device 16 than that of the blade 20 is.

The driving motor 40, as shown in FIGS. 2 and 3, is positioned on the base 10 below the intermediate base 11, having its driving shaft 41 engaged with a first driving wheel 42 and a second driving wheel 43 respectively, with the diameter of the first driving wheel 42 larger than that of the second driving wheel 43. A first driving element 44 is mounted on the first driving wheel 42 and the rotating wheel 22 of the blade 20, and a second driving element 45 is mounted on the second driving wheel 43 and the rotating wheel 32 of the grinding roller 30. Both of the first driving element 44 and the second driving element 45 are belts. As the diameter of the first driving wheel 42 is larger than that of the second driving wheel 43, the blade 20 can thus be whirled with a higher rotating speed.

In order to further understand the structural features, operative techniques and expected effects of the invention, how to use the invention is to be described below.

As shown in FIGS. 1~5 again, when the planing and polishing machine 100 is to be operated to plane and polish a piece of wood, the adjusting wheel 14 is first turned around to adjust the distance between the intermediate base 11 and the upper base 12. By the time, the conveying device 16 is to be moved up and down together with the intermediate base 11, positioned at a level according to the scale 15 so as to provide a precise transportation depth for a piece of wood to be planed. Then, the driving motor 40 can be turned on to drive the first driving wheel 42 and the second driving wheel 43 to spin in diverse speed, enabling the blade 20 to rotate faster so as to appropriately carry out planing. Meanwhile, the rollers 121 of the upper base 12 are to be synchronously drawn by the wood to rotate, so that the wood can be steadily pressed against the conveying band 163 to be smoothly planed. It is to be noted that the distance between the conveying device 16 and the upper base 12 can be altered any time so as to achieve a precise transportation depth. The wood is finally finished by the grinding wheel 30 to have a polished surface.

While the preferred embodiment of the invention has been described above, it will be recognized and understood that various modifications may be made therein and the appended claims are intended to cover all such modifications that may fall within the spirit and scope of the invention.

What is claimed is:

1. A planing and polishing machine comprising:

a base having an intermediate base and an upper base orderly installed above said intermediate base, said intermediate base and said upper base being spaced apart with a preset distance, a conveying device positioned on said intermediate base for laying a workpiece;

at least a blade transversely and pivotally positioned above said upper base and directed to an input said conveying device;

at least a grinding wheel transversely and pivotally installed above said upper base and positioned next to said blade above a output of said conveying device; and a driving motor positioned below said conveying device and having its driving shaft engaged with a first driving wheel and a second driving wheel respectively, said first driving wheel and said second driving wheel possessing a different diameter, a first driving element mounted on said first driving wheel and said blade, a second driving element mounted on said second driving wheel and said grinding roller.

2. The planing and polishing machine as claimed in claim 1, wherein said first driving element and said second driving element are respectively a belt.

3. The planing and polishing machine as claimed in claim 1, wherein four corners between said intermediate base and said upper base are respectively fixed with an adjusting screw, and a transverse rod is axially linked between two adjacent ones of said adjusting screws at two sides of said intermediate base respectively, with an adjusting wheel fixed at one side of one of said transverse rods for adjusting a distance between said intermediate base and said upper base so as to further adjust a transportation distance between said blade and said grinding wheel and said conveying device.

4. The planing and polishing machine as claimed in claim 1, wherein said blade is provided with a shaft pivotally connected at its one side to extend outside said upper base and engaged with a first rotating wheel that is mounted by a first driving element that also mounts on said first driving wheel, and said grinding wheel is provided with a shaft pivotally connected at its one side to extend outside said upper base beside said first rotating wheel and engaged with a second rotating wheel that is mounted by a second driving element that also mounts on said second driving wheel.

5. The planing and polishing machine as claimed in claim 1, wherein a surface of said grinding wheel is closer to said conveying device than that of said blade.

6. The planing and polishing machine as claimed in claim 1, wherein said first driving wheel has a larger diameter than said second driving wheel does.

* * * * *